United States Patent [19]

Yorita

[11] Patent Number: 4,473,731

[45] Date of Patent: Sep. 25, 1984

[54] VACUUM CIRCUIT INTERRUPTER

[75] Inventor: Mitsumasa Yorita, Itami, Japan

[73] Assignee: Mitsubishi Denki Kabushiki Kaisha, Tokyo, Japan

[21] Appl. No.: 446,216

[22] Filed: Dec. 2, 1982

[30] Foreign Application Priority Data

Dec. 9, 1981 [JP] Japan ..... 56-199657

[51] Int. Cl.[3] ..... H01H 33/66

[52] U.S. Cl. ..... 200/144 B; 200/238

[58] Field of Search ..... 200/144 B, 238

[56] References Cited

U.S. PATENT DOCUMENTS

| | | | |
|---|---|---|---|
| 3,946,179 | 3/1976 | Murano et al. | 200/144 B |
| 4,196,327 | 4/1980 | Kurosawa et al. | 200/144 B |
| 4,210,790 | 7/1980 | Kurosawa et al. | 200/144 B |

*Primary Examiner*—Harry E. Moose, Jr.
*Assistant Examiner*—Morris Ginsburg
*Attorney, Agent, or Firm*—Wenderoth, Lind & Ponack

[57] ABSTRACT

The disclosed electrode assembly used with vacuum circuit interrupters has a disc-shaped electrode including four coil sections defined by four short radial slots extending radially inward at equal angular intervals from its periphery, four circumferential slots extending in a common circumferential direction from the inner ends of the radial slots and terminating short of the adjacent radial slots to define base ends of the coil sections between the ends of the circumferential slots, and a short-circuiting member including a connecting ring connected to an extremity of an electrode rod, and four L-shaped radial arms extending radially outward at equal angular intervals from the connecting ring and perpendicularly to the longitudinal axis of the ring with their free ends connected to the end portions of the coil sections remote from the base ends. The circumferential slots may have a radial slot extending radially inward toward the center of the electrode.

7 Claims, 13 Drawing Figures

FIG. 1.
(PRIOR ART)
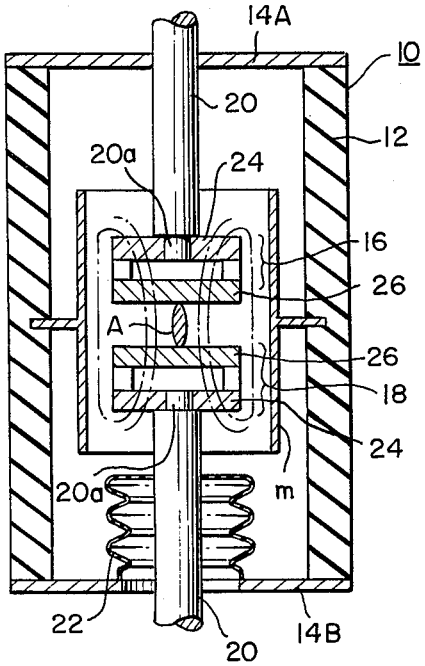
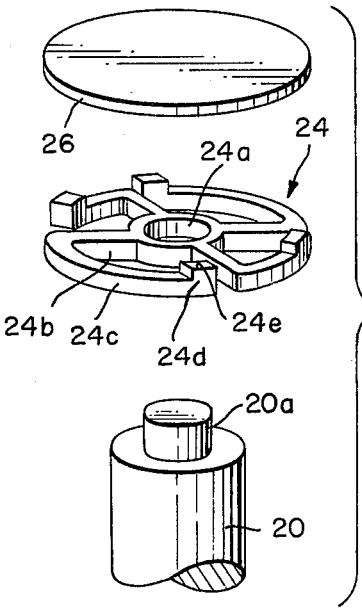
FIG. 2.
(PRIOR ART)
FIG. 3.
(PRIOR ART)
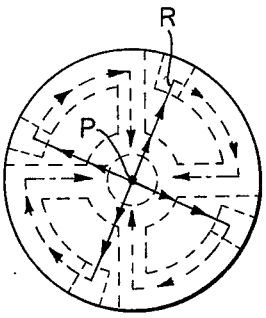
FIG. 4.
(PRIOR ART)
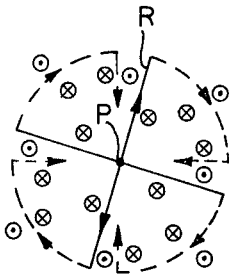

FIG. 5.
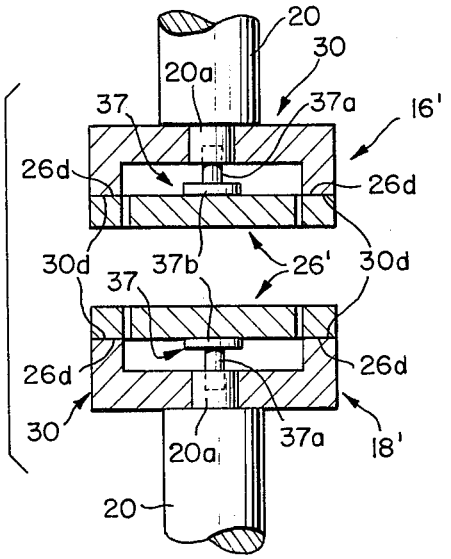
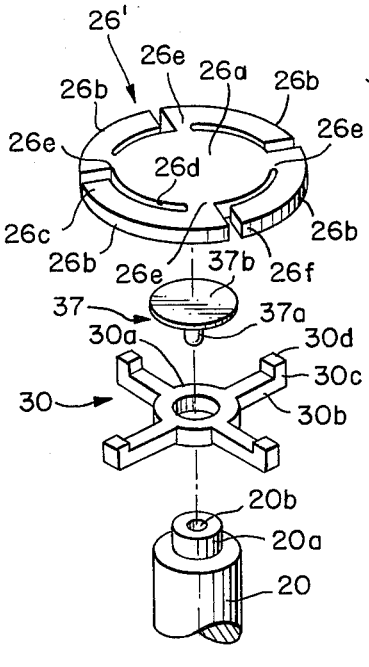
FIG. 6.
FIG. 7.
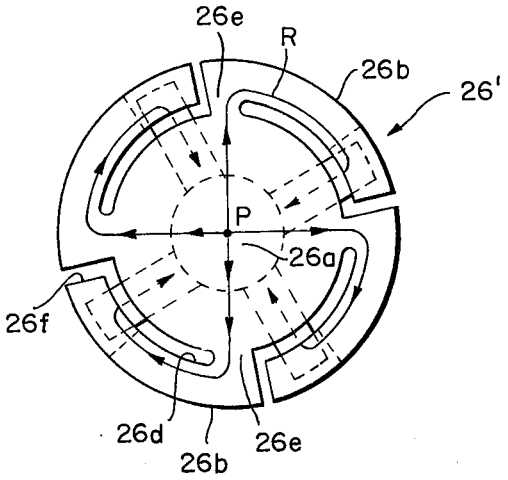
FIG. 8.
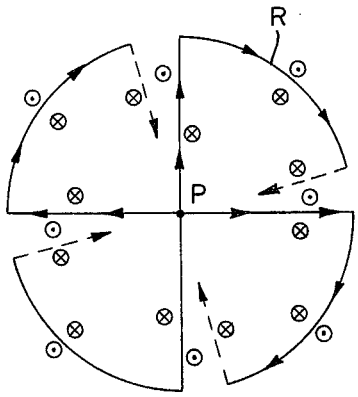

VACUUM CIRCUIT INTERRUPTER

BACKGROUND OF THE INVENTION

This invention relates to improvements in a vacuum circuit interrupter.

A conventional vacuum circuit interrupter has comprised an evacuated envelope, and a pair of electrode assemblies, one stationary and one movable, and disposed in opposed relationship within the evacuated envelope, the stationary assembly having a stationary electrode rod extending through and sealed in one end of the envelope and the movable assembly having a movable electrode rod movably extending in hermetic sealed relationship through the other end of the envelope.

The movable electrode assembly has comprised a metallic coil electrode including an annular holder fixedly fitted onto the extremity of the movable electrode rod, four radial arms extending from the holder radially and at equal angular intervals of 90 degrees perpendicularly to the axis of the annular holder and having equal lengths, four circumferential arms from the extremities of the radial arms running in a common direction along a common circle concentric with the annular holder and terminating short of the adjacent radial arms to form four coil sections in the form of circular arcs equal in arc length to one another, and four short connections extending from the extremities of the circumferential arms perpendicularly thereto and spaced from the mating electrode rod and with flat ends flush with one another. A main electrode in the form of a metallic disc has been disposed on the four flat ends of the connections to complete the movable electrode assembly. The stationary electrode assembly has been identical in structure to the movable electrode assembly as described above.

Upon the occurrence of an electric arc at the center of the main electrode, a current has flowed through current paths each traced from the center of the main electrode through the associated connection, the mating circumferential arm and the mating radial arm of the coil electrode and thence to the associated electrode rod through the annular holder so as to establish an axial magnetic field on the surfaces of the main electrodes and in the space therebetween to effectively interrupt the particular overcurrent.

In conventional vacuum circuit interrupters such as described above, the distance between the coil electrode and the surface of the main electrode or the space between the opposed main electrodes is rather large so that magnetic flux leaks from the axial magnetic field established by the coil electrode. As a result, a uniform magnetic field has been unable to be established on the surfaces of the main electrodes and in the space therebetween. Also in order to establish the magnetic field, it has been required to use a coil electrode in the form of circular arcs about the associated electrode rod and also radially. This has resulted in the disadvantages that the structure is complicated and lacks in mechanical strength and a compact structure is impossible.

Accordingly it is an object of the present invention to provide a new and improved vacuum circuit interrupter capable of establishing a uniform, stable axial magnetic field on the surfaces of the particular electrodes serving as contacts and more particularly on the peripheral portions of the surfaces of the electrodes and in a space formed therebetween with a simple structure and without the necessity of using a coil electrode such as that previously required.

SUMMARY OF THE INVENTION

The present invention provides a vacuum circuit interrupter comprising an evacuated envelope, a pair of disc-shaped electrodes disposed within the evacuated envelope and mounted on respective electrode rods, one of which is movable so as to engage and disengage the electrodes thereby to close and open an associated current path, a plurality of coil sections extending in a common circumferential direction on the peripheral portion of at least one of the pair of the electrodes to form circular arcs equal in arc length to one another, each of the coil sections including a base end disposed on an outer periphery of a central portion of the electrode and connected to the central portion, and a short-circuiting member interposed between at least one electrode and the associated electrode rod to short circuit the ends of the coil sections opposite to the base ends to the associated electrode rod.

In a preferred embodiment of the present invention the plurality of coil sections are defined by a plurality of short radial shots, one for each coil section, positioned at predetermined equal intervals and extending radially from the periphery of the electrode and equal in length to one another, a plurality of circumferential slots extending from the radially inner ends of the radial slots and running in a common circumferential direction and terminating short of the adjacent radial slots to form circular arc shaped coil sections equal in arc length to one another and concentric with the electrode and having the base ends of the coil sections located between the ends of the adjacent circumferential slots. The short-circuiting member includes a connecting ring fixedly fitted onto the associated electrode rod, a plurality of L-shaped radial arms, one for each coil section and extending radially outwards at predetermined equal angular intervals from the outer periphery of the connecting ring, each of the L-shaped radial arms having a short leg of the "L" perpendicular to the other leg thereof forming a short connection portion connected to the associated coil section on a coil end portion remote from the base end.

BRIEF DESCRIPTION OF THE DRAWINGS

The present invention will become more readily apparent from the following detailed description taken in conjunction with the accompanying drawings in which:

FIG. 1 is an elevational sectional view of a conventional vacuum circuit interrupter with parts illustrated in elevation;

FIG. 2 is an exploded perspective view of one of the electrode assemblies with an electrode rod shown in FIG. 1;

FIG. 3 is a plan view of one of the electrode assemblies shown in FIGS. 1 and 2 and useful in explaining the current flowing therethrough upon the occurrence of an electric arc thereon;

FIG. 4 is a plan view of the branches of the current path shown in FIG. 3 and the sense of the resulting axial magnetic field;

FIG. 5 is an elevational sectional view of one embodiment of the vacuum circuit interrupter of the present invention with parts illustrated in elevation and with some parts omitted;

FIG. 6 is an exploded perspective view of one of the electrode assemblies shown in FIG. 5 with the associated electrode rod also shown in FIG. 5;

FIG. 7 is a view similar to FIG. 3 but illustrating the current flowing in the electrode of the present invention;

FIG. 8 is a diagram similar to FIG. 4 but illustrating the current paths in the electrode of the present invention;

Throughout the Figures like reference numerals designate the identical or corresponding components.

DETAILED DESCRIPTION OF THE PREFERRED EMBODIMENTS

Figure 9:
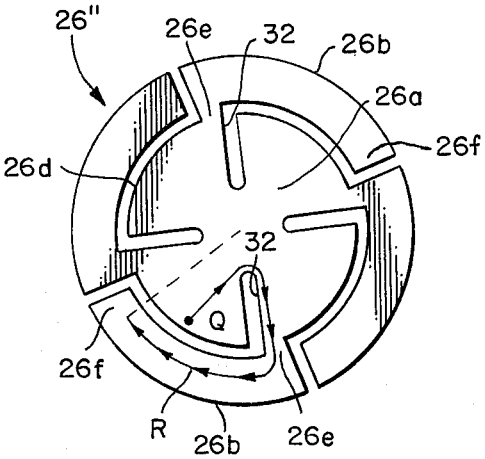
FIG. 9 is a plan view of a modification of the electrode shown in FIGS. 5 and 6.

Referring now to FIG. 1 of the drawings, there is illustrated a conventional vacuum circuit interrupter. The arrangement illustrated comprises an evacuated envelope generally designated by the reference numeral 10 and including a cylindrical wall 12 of an electrically insulating material having both ends closed with a pair of metallic and plates 14A and 14B respectively, and a pair of electrode assemblies 16 and 18, one movable and one stationary, respectively disposed in opposed relationship in the space defined by the cylindrical wall 12, the movable assembly 18 being movable to engage and disengage from the stationary assembly 16. The stationary electrode assembly 16 is connected at the center of the rear surface or the upper surface thereof as viewed in FIG. 1 to an electrode rod 20 extending centrally through and sealed in the upper end plate 14A to the exterior of the arrangement. The movable electrode assembly 18 is similarly connected to another electrode rod 20 which, in turn, extends centrally through and is sealed in a closed end of a bellows 22 including an open end hermetically connected to a periphery of a central opening in the lower end plate 14B as viewed in FIG. 1. Thus the electrode rod 20 connected to the movable electrode assembly 18 passes through the bellows 22 and movably extends through the central opening in the lower end plate 14B.

Thus the stationary and movable electrode assemblies 16 and 18 respectively are normally located in opposed relationship within the evacuated envelope 10 formed of the electrically insulating cylindrical wall 12, the end plates 14A and 14B and the bellows 22, on the respective electrode rods 20.

The stationary and movable electrode assemblies 16 and 18 respectively are identical in structure to each other and each of the electrode assemblies 16 and 18 is composed of a metallic coil electrode 24 and a main electrode 26 in the form of a metallic disc.

An intermediate metallic shield m is suitably supported on the cylindrical wall 12 and surrounds the stationary and movable electrode assemblies 16 and 18 respectively thereby to prevent the inner surface of the cylindrical wall 12 from being contaminated by electric arcs established across the main electrodes 26.

FIG. 2 shows the details of one of the electrode assemblies, in this case, the movable electrode assembly 18 and the movable electrode rod 20 connected thereto. As shown in FIG. 2, the electrode rod 20 includes at its extremity a reduced diameter portion 20*a* which is, in turn, fixedly fitted in an annular holder 24*a* centrally disposed on the coil electrode 24. The coil electrode 24 includes further a plurality of radial arms 24*b*, in this case, four arms extending radially outward at predetermined equal angular intervals from the annular holder 24*a* and perpendicularly to the central axis thereof and equal in length to one another, and a plurality of circumferential arms 24*c* extending from the free ends of the associated radial arms 24*b* in a common peripheral direction and terminating short of the adjacent radial arms 24*b* to form circular arcs concentric with the annular holder 24*a* and equal in arc length to one another. Each of the circumferential arms 24*c* is provided at the free end with a connection 24*d* somewhat extending in parallel to the longitudinal axis of the annular holder 24*a* and spaced from the mating electrode rod 20 and terminating in a flat end surface 24*e* which is flush with connecting flat end surfaces 24*e* on the remaining circumferential arms 24*c*.

The main electrode 26 is substantially equal in diameter to a circle defined by the outer peripheries of the circumferential arms 24*c* and is connected to the coil electrode 24 by having its rear surface connected to the connecting flat end surfaces 24*e* of the coil electrode 24.

The stationary electrode assembly 16 is identical to the movable electrode assembly 18 and disposed in opposed relationship to the latter so that the main electrodes 26 face each other with a predetermined spacing therebetween as shown in FIG. 1.

The operation of the arrangement shown in FIGS. 1 and 2 will now be described. Assuming that an electric arc occurs at the center of the main electrode 26 as shown in FIG. 1, a current flows in parallel through four current paths R shown in FIG. 3 wherein there is also illustrated the main electrode 26 with the coil electrode 24 underlying it shown in broken lines. Each of the current paths extends from the center P (see FIG. 3) of the main electrode 26 through the associated connection 24*d*, the mating circumferential arm 24*c* and the connected radial arm 24*b* of the coil electrode 24 and thence to the electrode rod 20 through the annular holder 24*a* of the coil electrode 24. This results in the establishment of an axial magnetic field in the clockwise direction according to Ampere's law as shown by the conventional notations "plus" and "dot" in respective circles in FIG. 4. That axial magnetic field effectively suppresses the resulting plasma spontaneously diffused in the interior of the evacuated envelope 10 upon interruption of a high current by the arrangement of FIG. 1. This causes a decrease in arc voltage developed across the main electrodes upon the interruption and also the arc column is permitted to diffuse on the entire surface of the main electrodes without its being concentrated at a single point on the surface thereof. Thus the interrupting performance can be greatly improved.

In a conventional vacuum circuit interrupter such as described above, the coil electrode for establishing the axial magnetic field is located to the rear of the main electrode with respect to the electric arc developed on the the surface of the main electrode. This means that the distance from the coil electrode to the surface of the main electrode or the space formed therebetween becomes long resulting in magnetic flux leaking from the axial magnetic field established by the coil electrode. As a result, it has not been possible with this arrangement to establish a uniform magnetic field on the surfaces of and in the space between the electrodes. Also the establishment of the magnetic field has required the coil electrode to extend in the form of circular arcs about the mating electrode rod and also radially. This has resulting in the disadvantages that the resulting structure becomes complicated, and lacks mechanical strength and a compact structure is impossible.

The present invention seeks to eliminate the disadvantages of the prior art as described above by the provision of an electrode serving as a contact and including coil portions disposed at the outer periphery to establish the axial magnetic field as described above.

Referring now FIG. 5, there is illustrated one embodiment of the electrode assembly of the present invention. The arrangement illustrated comprises a pair of stationary and movable electrode assemblies 16' and 18' respectively disposed in opposed relationship in the same manner as described above in conjunction with FIG. 1, within an evacuated envelope (not shown) similar to that shown in FIG. 1.

As in the arrangement of FIG. 1, the stationary and movable electrode assemblies 16 and 18 are identical to each other and one of them, in this case, the movable electrode assembly 18, is shown in detail in FIG. 6 with a mating electrode rod. The arrangement illustrated comprises an electrode rod 20 similar to that shown in FIG. 2 and a short-circuiting member 30 connected to the electrode rod 20. More specifically, the short-circuiting, member 30 includes a connecting ring **30*a* at the central portion thereof fixedly fitted onto the reduced diameter extremity 20*a* of the electrode rod 20 and a plurality of L-shaped radial arms, in this case, four arms, extending radially outward extending at predetermined equal angular intervals from the outer periphery of the connecting ring 30*a* and perpendicularly to the central axis thereof. The radial arms are equal in length to one another and each of them has the longer leg of the "L" forming a radial arm portion 30*b* and the short leg 30*c* therefor extending from the free end of the radial arm portion 30*b* spaced from the associated electrode rod 20 and perpendicular to the arm portion 30*b*. The leg 30*c* of the "L" forms a connection portion 30*c* having a flat end surface 30*d* substantially flush with the flat end surfaces of the other connection portions 30*c***.

A dish-shaped metallic electrode 26' corresponding to the main electrode in FIGS. 1 and 2 is disposed on the connection portions **30*d* of the short-circuiting member 30 by having the rear surface fixed to the flat end surfaces 30*d* of the short-circuiting member 30. The electrode 26' is substantially equal in diameter to a circle passing through the free ends of the radial arms portions 30*b* and includes a central section 26*a* in the form of a disc and a plurality of coil sections 26*b*, in this case four coil sections, in the form of circular arcs equal in arc length to one another and concentric with the electrode 26', one for each of the radial arms 30*b*, 30*c***.

More specifically a plurality of radial slots **26*c*, in this case four slots, extend radially inward at predetermined equal angular intervals from the periphery of the electrode 26' for equal and short distances and have circumferential slots 26*d* extending from the inner ends of the radial slots in a common circumferential direction along a circle concentric with the electrode 26 and terminating short of the adjacent radial slots 26*c* to define base end portions 26*e* between the circumferential slots 26*d* and the adjacent radial slots 26*c* respectively. In this way each of the coil sections 26*b* is disposed on an outer peripheral portion of the electrode 26' and defined by corresponding adjacent radial slots 26*c*, the circumferential slots 26*d* and base end portions 26*e*. Each base end portion 26*e* serves to connect the corresponding coil section 26*b* to the central section 26*a* of the electrode 26' while the radial slot 26*c* and adjacent portions of the circumferential slot 26*d* and the outer periphery of the electrode 26' define an extremity 26*f* of the coil section 26*b* which, in turn, abuts against a connection portion 30*c* of the short circuiting member 30**.

Thus the electrode 26' is electrically connected to the shortcircuiting member 30 by having the four extremities **26*f* abutting against the associated connection portions 30*c***.

Further a supporting member 37 having a high electric resistivity includes a rod **37*a* fixedly fitted into a central hole 20*b* in the reduced diameter extremity 20*a* of the electrode rod 20 and a disc 37*b* connected at the center to the rod 37*a* and supporting the central portion of that surface of the electrode 26' facing the short-circuiting member 30**.

The stationary electrode assembly 16' connected to the mating electrode rod 20 is identical to the movable electrode assembly 18' connected to the mating electrode rod 20 and opposed to the latter within the evacuated envelope (not shown) as shown in FIG. 5, as described above to form a vacuum circuit interrupter.

Assuming that an electric arc occurs at the center P of the surface of electrode 26' (see FIG. 7 wherein there is illustrated the electrode 26' with the short-circuiting member 30 underlying it and hown in dotted lines), a current flows through current paths R (see FIG. 7) traced from the center P through four radially outward directed lines on the central portion **26*a*, the corresponding base end portions 26*e*, the corresponding coil sections 26*b*, the extremities 26*f*, the associated connection portions 30*c* of the short-circuiting member 30, the corresponding radial arm portions 30*b* thereof, the connecting ring 30*a* thereof and thence to the associated electrode rod 20. Thereby an axial magnetic field is established around each of the current paths R as shown in FIG. 8** wherein the conventional notations "plus" and "dot" in respective circles are used to indicate the sense of the axial magnetic field.

At that time a magnetic flux is permitted only to leak in small amounts from the magnetic field established on the coil sections **26*b* on the surfaces of the electrodes 26' and in the space formed therebetween. This is because that magnetic field originates from the electrodes 26' themselves. Also since the distance between the opposed electrodes 26' is short, the magnetic field is strong. Further the coil sections 26*b* are provided on the electrodes 26'** themselves thereby eliminating the necessity of separately providing a coil electrode as previously required.

While the present invention has been described in conjunction with the four coil sections disposed on each electrode it is to be understood that each electrode may be provided with any number of coil sections other than four. In the latter case, the number of the coil sections on the electrode may be changed to vary currents flowing through the coil sections. Thus the resulting magnetic field can be varied by intensity.

FIG. 9 shows a modification of the present invention. The arrangement illustrated is different from that shown in FIG. 6 only in that in FIG. 9 each of the circumferential slots **26*d* has extending from that end adjacent to the base end portion 26*c* a radial slot 32 extending radially inward toward the center of the electrode 26''. Those radial slots 32 are substantially equal in length to one another and are disposed adjacent to the base end portions 26e of the associated coil sections 26b**.

Figure 10:
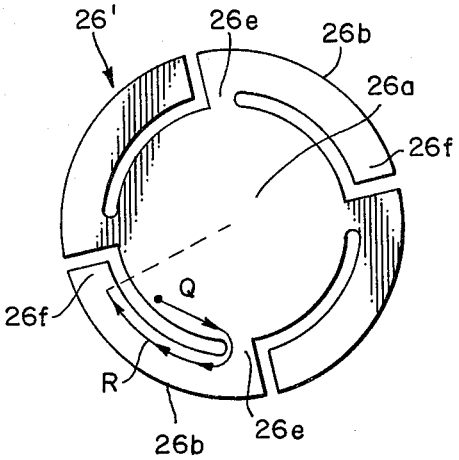
FIG. 10 is a view similar to FIG. 7 and useful in comparing the operation with the arrangement shown in FIG. 9.

The arrangement of FIG. 9 is effective for ensuring a uniform intensity of the axial magnetic field developed when an electric arc occurs on the peripheral portion of the electrode 26'', for example, at a point Q located adjacent to one of the circumferential slot 26d on the radially inner side thereof as shown in FIG. 9 or FIG. 10 wherein there is illustrated the electrode 26' shown in FIG. 6 or 7. In the absence of the radial slots 32 the resulting current path traced from the point Q to the associated electrode rod 20 is shifted to that coil section 26b located radially outside of the circumferential slot 26d running past the point Q as shown by the reference character R in FIG. 10. Thus the magnetic field is principally established on those portions of the surfaces of and in the space between the electrodes located adjacent to the point Q. This causes a problem that the intensity of the magnetic field is locally changed.

In the arrangement of FIG. 9, however, that radial slot 32 located adjacent to the point Q causes the resulting current from the point Q to flow toward the center of the electrode 26'' after which the current is dispersed to flow through the respective coil sections 26b as shown typically by the current path R adjacent to the point Q in FIG. 9. Thus the current is not to be shifted to the single coil section 26b. As a result, the magnetic field established is uniform on the surfaces of and in the space between the electrodes 26''.

Figure 11:
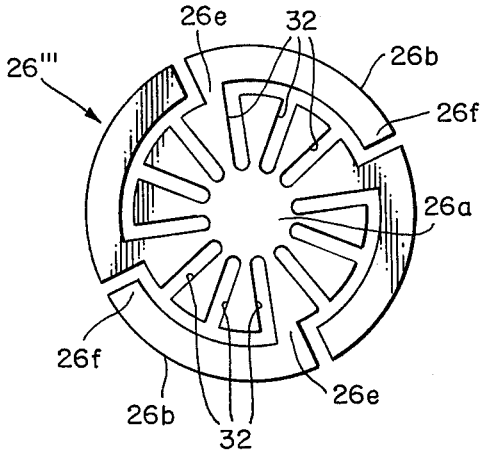
FIGS. 11, 12 and 13 are plan views of different modifications of the arrangement shown in FIG. 9.

While the arrangement of FIG. 9 includes the radial slots 32 equal in number to that of the coil sections 26b, it is to be understood that the present invention is not restricted thereby or thereto and that the number of the radial slots 32 may be different from that of the coil sections 26b. For example, a plurality of radial slots from each of the circumferential slots 26d may extend radially inward at predetermined equal angular intervals toward the center of the electrode 26'' and terminate at equal distances from that center. FIG. 11 illustrates an electrode 26''' with, in addition to the radial slot 32 of FIG. 9, two additional radial slots 32 from each circumferential slot 26d and extending in the same manner as the radial slot 32 from the end of each of the slots 26d.

The arrangements illustrated in FIGS. 9 and 11 are advantageous over the arrangement shown in FIG. 5 in that the resulting magnetic field is more uniform and also it is possible to decrease the eddy currents generated on the surface of each electrode upon the establishment of an axial magnetic field.

Figure 12:
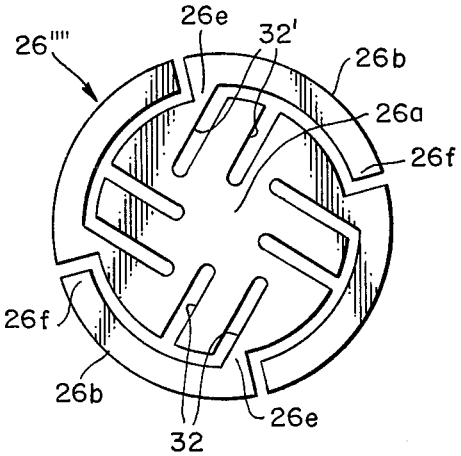
Figure 13:
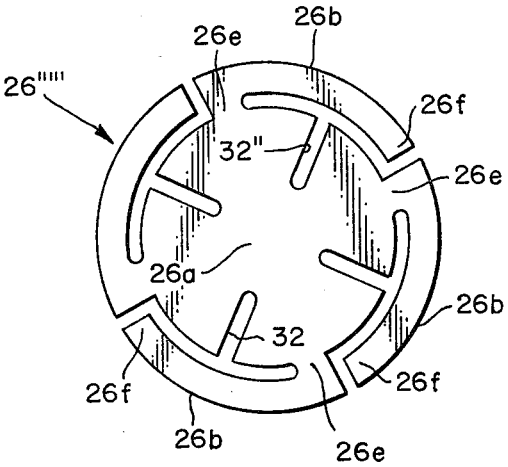

The arrangement of FIG. 11 may be modified as shown in FIG. 12 or 13. In FIG. 12, the electrode 26'''' has a pair of spaced slots 32' from each of the circumferential slots 26d extending in parallel relationship toward the inner portion of the electrode 26'''' in a direction other than toward the center of the electrode 26''. In FIG. 13, a single radial slot 32 extends radially toward the center of the electrode 26'''' starting from the middle portion of the associated circumferential slot 26d but spaced from the base end thereof.

From the foregoing it is seen that the present invention provides a vacuum circuit interrupter comprising a pair of disc-shaped electrodes disposed in an evacuated envelope to open and close an associated current path, and a plurality of coil sections disposed on the outer peripheral portion of each of the electrodes. This measure causes the electrodes themselves to establish an axial magnetic field on the surfaces of the electrodes resulting in a reduction in leakage of a magnetic flux. Also the magnetic field can be changed in intensity by varying the number of the coil sections. This is because the intensity of the magnetic field changes in accordance with the number of the coil sections. In addition the coil sections are disposed on the electrode itself resulting in the elimination of the necessity of separately providing a coil electrode such as previously required. Accordingly the present invention provides a vacuum circuit interrupter having a simplified structure and reduced manufacturing cost.

While the present invention has been illustrated and described in conjunction with a few preferred embodiments thereof it is to be understood that numerous changes and modifications may be resorted to without departing from the spirit and scope of the present invention. For example, it is to be understood that a plurality of coil sections may be provided on only one of the pair of electrodes.

What is claimed is:

1. A vacuum circuit interrupter comprising:

an evacuated envelope;

a pair of electrode assemblies positioned within said evacuated envelope;

electrode rods extending into said envelope and on the ends of which said electrode assemblies are mounted, one of said rods being movable into and out of said envelope to move said electrode assemblies into and out of contact thereby to close and open an associated current path;

each electrode assembly comprising a disc-shaped electrode electrically insulated from the corresponding electrode rod, a plurality of coil sections extending in a common circumferential direction around a peripheral central portion of at least one of said pair of electrodes in circular arcs equal in arc length to one another, each of said coil sections including a base end disposed on the outer periphery of said central portion of said at least one electrode and electrically connected to said central portion, the remainder of said coil sections being spaced from said peripheral central portion, and a short-circuiting member connected between free ends of said coil sections on said at least one electrode and the corresponding electrode rod for short-circuiting said coil sections to said electrode rod.

2. A vacuum circuit interrupter as claimed in claim 1 wherein said electrode disc has a plurality of short radial slots, one for each coil section, extending radially inward from the periphery of said electrode disc at predetermined equal angular intervals and equal in length to one another, and a plurality of circumferential slots extending from the radially inner ends of said radial slots in a common circumferential direction and terminating short of the adjacent radial slots to form circular arcs equal in length to one another and concentric with said electrode, said slots defining said coil sections and said base ends of said coil sections being located between the ends of said circumferential slots.

3. A vacuum circuit interrupter as claimed in claim 1 wherein said short-circuiting member has a connecting ring fixedly fitted onto the inner end of the corresponding electrode rod, and a plurality of L-shaped radial arms, one for each coil section, having the longer legs thereof extending radially outward at predetermined angular intervals from the outer periphery of said connecting ring and perpendicularly to the longitudinal axis of said connecting ring, and the shorter legs connected to the corresponding coil sections.

4. A vacuum circuit interrupter as claimed in claim 2 wherein said one electrode has at least one further slot therein extending from one of said circumferential slots toward the interior of said central portion.

5. A vacuum circuit interrupter as claimed in claim 4 wherein there is a radial slot extending radially inwardly from the end of each said circumferential slot at said base end of the corresponding coil section.

6. A vacuum circuit interrupter as claimed in claim 4 wherein there is a plurality of radial slots extending radially inwardly from each circumferential slot and in spaced relationship along said slot.

7. A vacuum circuit interrupter as claimed in claim 4 wherein there is a plurality of slots extending in spaced, parallel relationship from each of said circumferential slots in a direction other than radially toward the center of said electrode.

* * * * *